United States Patent [19]

LoBello

[11] Patent Number: 5,038,271

[45] Date of Patent: Aug. 6, 1991

[54] TRANSPORTABLE LIGHTED POUCH

[76] Inventor: Peter J. LoBello, 130 Beechwood Dr., Mamaroneck, N.Y. 10543

[21] Appl. No.: 443,148

[22] Filed: Nov. 30, 1989

[51] Int. Cl.[5] ..... F21V 33/00

[52] U.S. Cl. ..... 352/154; 362/116; 362/156; 362/189; 362/190

[58] Field of Search ..... 362/109, 116, 154, 156, 362/189, 190, 191, 200

[56] References Cited

U.S. PATENT DOCUMENTS

| | | | |
|---|---|---|---|
| 1,183,268 | 5/1916 | Baldwin et al. | 362/156 |
| 2,068,813 | 1/1937 | Morey | 362/156 |
| 3,243,586 | 3/1966 | Fioravanti | 362/116 |
| 3,359,411 | 12/1967 | Schwartz | 362/189 X |
| 4,774,638 | 9/1988 | Caires | 362/156 |
| 4,912,611 | 3/1990 | Lyle | 362/156 |

*Primary Examiner*—Stephen F. Husar
*Assistant Examiner*—Sue Hagarman

[57] ABSTRACT

A pouch detachably mountable at a receiving position within a second enclosure, the pouch comprising a resealable enclosure having mounted thereon a lighting circuit, the lighting circuit including a power source, a switch for actuating the lighting circuit, the switch being arranged for actuation from the exterior of the enclosure, and a light source, the light source being arranged to project the light away from the enclosure. The pouch is further provided with structure for detachably mounting the pouch at the receiving position.

7 Claims, 1 Drawing Sheet

TRANSPORTABLE LIGHTED POUCH

INTRODUCTION AND SUMMARY OF THE INVENTION

The present invention pertains to a transportable lighted pouch detachably mountable to receiving means, the pouch including a light circuit actuatable from the exterior of the pouch for projecting a light beam away from the pouch and mounting means for detachably mounting the pouch to the receiving means.

For convenience in the dark, it has been proposed to provide various structures having an integral light source, for example, a key ring and integral penlight. Such a structure facilitates the use of keys in the dark, since both the keys and the light are co-located.

To its disadvantage, however, such a structure cannot be maintained in one easily accessible spot. Thus, a single structure like a penlight/key ring is often difficult to locate within, for example, a pocketbook. Moreover, in addition simply to keys, it may be desired to keep a wide variety of items or effects (for example, keys, spare change and the like) together so that they may be easily found. This problem is more acute in the dark where the location of these items cannot be easily ascertained simply by looking within the pocketbook.

These needs are met by the present invention which provides a pouch detachably mountable to receiving means. The pouch includes a resealable enclosure having mounted thereon a lighting circuit, the lighting circuit including a power source, a switch for actuating the lighting circuit, the switch being arranged for actuation from the exterior of the enclosure, and a light source, the light source being arranged to project light away from the enclosure. The pouch further includes mounting means for detachably mounting the pouch to the receiving means.

DETAILED DESCRIPTION OF THE PREFERRED EMBODIMENT

Figure 1:
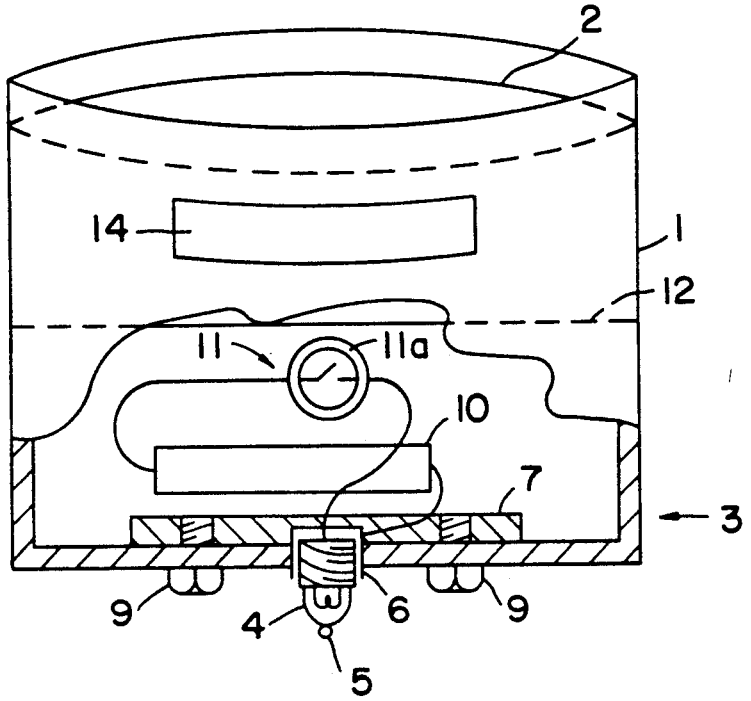
FIG. 1 is a partially cut away perspective view of a preferred embodiment of the invention.

FIG. 1 shows a preferred embodiment of a pouch 1 according to the present invention in the form of a change purse. As shown in FIG. 1, pouch 1 includes at its open end a resealable closure 2, for example a zipper.

At base 3 of the pouch, a lighting circuit has been provided. The lighting circuit includes a bulb 4, preferably of the penlight variety which has an integral lens 5 formed at its tip to condense the light projected therefrom into a beam. The bulb is arranged to project light away from the pouch.

Bulb 4 is received into base 6, which in turn is mounted onto plate 7. Plate 7 is fixed to base 3 of the pouch, for example by screws 9.

Above plate 7, a battery 10 and switch 11 are arranged in the lower recesses of the pouch 1. The battery and the switch are wired to the bulb in the well-known manner illustrated in FIG. 1 so as to complete the lighting circuit.

Switch 11 is of a type that is normally open but is momentarily closable by a squeezing or pressing force. Switch 11 should be mounted so as to be actuatable from the exterior of the pouch. For this purpose, it should be evident that the switch itself can be mounted on the exterior of the pouch. In any event, it may be desirable to provide protection means to prevent inadvertent actuation of the switch. As shown in FIG. 1, the protection means takes the form of a ring 11*a* encircling the push button of switch 11.

If desired, a separator in the form of a flap 12 may be provided to separate the lighting circuit from the remainder of the pouch.

A first half of a VELCRO strip 14, comprising mounting means, is fixed to the upper end of the pouch on the exterior surface thereof. This placement permits the pouch to hang naturally, that is with the heavier lighting circuit below the lighter upper end of the pouch.

Figure 2:
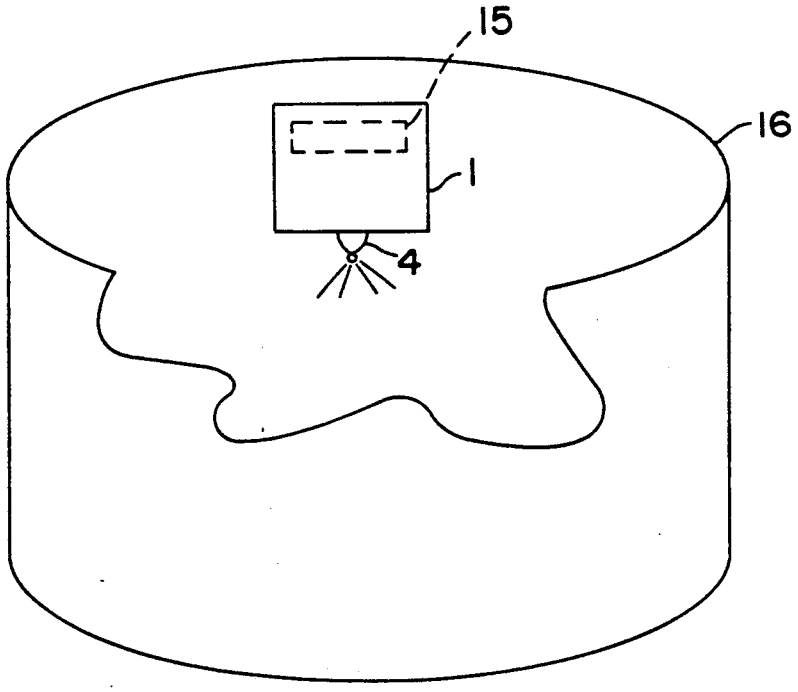
FIG. 2 is a perspective view of the embodiment of the invention in FIG. 1 shown in place within a second enclosure.

Referring to FIG. 2, the second half of a VELCRO strip 15, comprising receiving means, is fixed at a predetermined position in a second enclosure 16, for example a pocketbook. When the first and second halves of the VELCRO strip are engaged, this placement of the VELCRO strips permits the pouch 1 to be carried in a predetermined position within the pocketbook. Thus, a variety of items may be kept together within the pouch and may be located easily within the pocketbook since the pouch is mounted at a predetermined position within the pocketbook.

Once the pouch has been retrieved from the interior of the pocketbook, the lighting circuit may be actuated to facilitate the use of items stored in the pouch in the dark. Of course, the lighting circuit may simply be actuated without removing the pouch from the pocketbook so as to illuminate the interior of the pocketbook to retrieve other items stored in the pocketbook.

Additionally, it will be recognized that the second half of the VELCRO strip 15 provides tactile feedback in the dark to permit easy replacement of pouch 1 at its predetermined position without the need to supervise the replacement process visually.

Many different pocketbooks may be equipped with the second half of the VELCRO strip 15 in the same predetermined position. This allows transportability of pouch 1 between various pocketbooks without altering the predetermined location of the pouch within any of the pocketbooks, thereby simplifying retrieval of the pouch in the dark.

The foregoing description is provided so that those skilled in the art may comprehend specific aspects of the preferred embodiment of the invention. However, the invention should not be measured by reference to the above description, but instead should be measured by reference to the following claims.

What is claimed is:

1. A pouch detachably mountable to receiving means comprising:

a pouch-like enclosure having a resealable open end and a sealed base end opposite the open end, the pouch-like enclosure defining a compartment separated by a separator into a first area at the base end and a second area at the open end, the first area having mounted therein a lighting circuit, the lighting circuit including means for supplying power, a momentarily closable switch for actuating the lighting circuit by a squeezing or pressing force, means for preventing inadvertent actuation of said switch, and a light source, the switch being arranged for actuation from the exterior of said pouch-like enclosure, and the light source being arranged within said pouch-like enclosure and projecting through said base end, whereby the light source projects light away from said pouch-like enclosure; and mounting means on said pouch-like enclosure for detachably mounting said pouch to the receiving means.

2. A pouch according to claim 1, wherein said receiving means is arranged at a predetermined position within a second enclosure.

3. A pouch according to claim 2, wherein said receiving means is constructed to provide a tactile indication of its location.

4. A pouch according to claim 2, wherein said second enclosure is comprised by a pocketbook and wherein said resealable enclosure is comprised by a change purse.

5. A pouch according to claim 1, where said second area is adapted to receive various effects such as keys, coins and the like.

6. A pouch according to claim 1, further comprising a closure arranged at the resealable open end.

7. A pouch according to claim 1, wherein said pouch-like enclosure further includes a pair of sealed sides, respective ones of which are disposed intermediate the resealable open end and the sealed base end.

* * * * *